United States Patent [19]

Gorlitsin et al.

[11] 4,184,358

[45] Jan. 22, 1980

[54] DEVICE FOR MOUNTING A TOOL ON THE MOVABLE CROSSBEAM OF A PRESS

[76] Inventors: Sergei N. Gorlitsin, prospekt Ordzhonikidze, 10, kv. 80; Vladimir I. Koires, ulitsa Bakinskikh komissarov, 58, kv. 83; Alexandr I. Sokolov, prospekt Kosmonavtov, 29b, kv. 37, all of Sverdlovsk, U.S.S.R.

[21] Appl. No.: 900,514

[22] Filed: Apr. 27, 1978

[51] Int. Cl.[2] ..... B21J 13/02

[52] U.S. Cl. ..... 72/462; 83/698

[58] Field of Search ..... 72/462, 446, 447, 455; 83/698

[56] References Cited

U.S. PATENT DOCUMENTS

| | | | |
|---|---|---|---|
| 3,111,895 | 11/1963 | Kraft | 83/698 |
| 3,327,575 | 6/1967 | Duffee | 83/698 |
| 3,834,218 | 9/1974 | Kralowetz | 72/446 |

FOREIGN PATENT DOCUMENTS

| | | | |
|---|---|---|---|
| 1194227 | 6/1965 | Fed. Rep. of Germany | 72/446 |
| 544463 | 6/1922 | France | 72/462 |

*Primary Examiner*—Francis S. Husar
*Assistant Examiner*—Gene P. Crosby
*Attorney, Agent, or Firm*—Fleit & Jacobson

[57] ABSTRACT

The present invention relates to devices for mounting a tool on the movable crossbeam of a press. The device includes a tool holder carrying tool grippers mounted for relative motion toward and from a tool under the action of fluid-actuated power cylinders accommodated in the crossbeam. The device reduces the amount of labor required for tool replacement and eliminates manual labor.

2 Claims, 4 Drawing Figures

DEVICE FOR MOUNTING A TOOL ON THE MOVABLE CROSSBEAM OF A PRESS

The present invention relates to hydraulic presses, and, more particularly, it relates to devices for mounting a tool on the movable crossbeam of such presses.

The invention can be effectively utilized in presses of practically all types, including free-falling forging presses and die-pressing ones.

There are known various designs of devices for mounting a tool. Thus, in forging presses there are widely used devices for mounting the upper tool or die on the movable crossbeam by means of an adaptor plate and a die-holding housing, the die being fixed in the housing with aid of a dovetailed abutment on the die and a complementary groove in the housing. The groove in the housing is made wider than the abutment, to facilitate insertion of the die into the housing, with the die being subsequently fixed in the housing with a wedge either hammered-in manually or driven-in by impacts of a weight block suspended from a crane.

However, in presses of medium and high capacities both the size and weight of the wedge may be quite great—the wedge may be as long as two meters or even more and as heavy as several hundred kilograms. Therefore, a serious disadvantage of the abovedescribed mounting technique is the considerable amount of hard labour consumed by placing, securing and then releasing the wedge, with manual labour involved and a considerble amount of time wasted on mounting a tool, which affects the overall productivity of the press.

There is also known a device for mounting a hammer die on the movable crossbeam of a press. The device includes an adaptor plate and a housing adapted to carry the tool, i.e. the hammer die. The latter is fastened in the housing by the technique of the prior art, i.e. by means of dovetailed grooves and lugs, and a retaining wedge, while the housing is provided with pins receivable in the grooves of the adaptor plate. The pins are subsequently fastened in the grooves of the adaptor plate with wedge-type locks reciprocable by means of pneumatic drive means.

Although directed at reducing the amount of labour consumed by a tool-replacing operation, the last-described apparatus of the prior art involves the necessity of having additional sets of hammers assembled with housings, to say nothing of the fact that the fastening of the hammer in the housing by means of the wedge has the same disadvantages as the abovementioned fastening of a hammer directly in a housing rigidly fixed to the adaptor plate of the movable crossbeam of a press.

It is an object of the present invention to eliminate the aforesaid disadvantages.

It is an object of the present invention to provide a tool-mounting apparatus wherein grippers should be incorporated to significantly reduce the amount of labour consumed by a tool-replacing or changing operation.

It is an important object of the present invention to provide a tool-mounting apparatus which should eliminate manual labour.

It is still another object of the present invention to provide a tool-mounting apparatus which should step up the overall productivity of the entire press incorporating this apparatus.

These and other objects are accomplished in a device for mounting a tool on the movable crossbeam of a press, comprising a tool holder fastened on the crossbeam, in which device, in accordance with the invention, the tool holder has arranged thereon, to both sides of the axis of symmetry thereof, grippers for tools, mounted for relative motion toward and from the tool under the action of power cylinders accommodated in the tool holder. It is expedient that each one of the grippers should include a block accommodated in the respective groove of the tool holder, the end faces of the blocks having mounted thereon bell cranks of which the free ends cooperate with the rods of the power cylinders.

With a tool-mounting device having the herein disclosed structure, the amount of labour consumed by a tool replacing operation is reduced, with manual labour eliminated, because by moving the blocks in the grooves it has become possible to replace a tool rapidly and easily, while the actuation of the blocks by a single drive ensures their properly timed motion and, hence, simultaneous gripping of the tool.

In accordance with a preferred embodiment of the invention, each one of the grippers includes a roller with a flat made in the external surface thereof, extending axially of the roller, the end faces of the roller having mounted thereon arms of which the free ends are adapted to engage the first arms of bell cranks of which the other arms carry cams cooperating with the rods of the power cylinders.

For the invention to be better understood, given hereinbelow is a description of embodiments thereof, with reference being made to the accompanying drawings, wherein.

Figure 1:
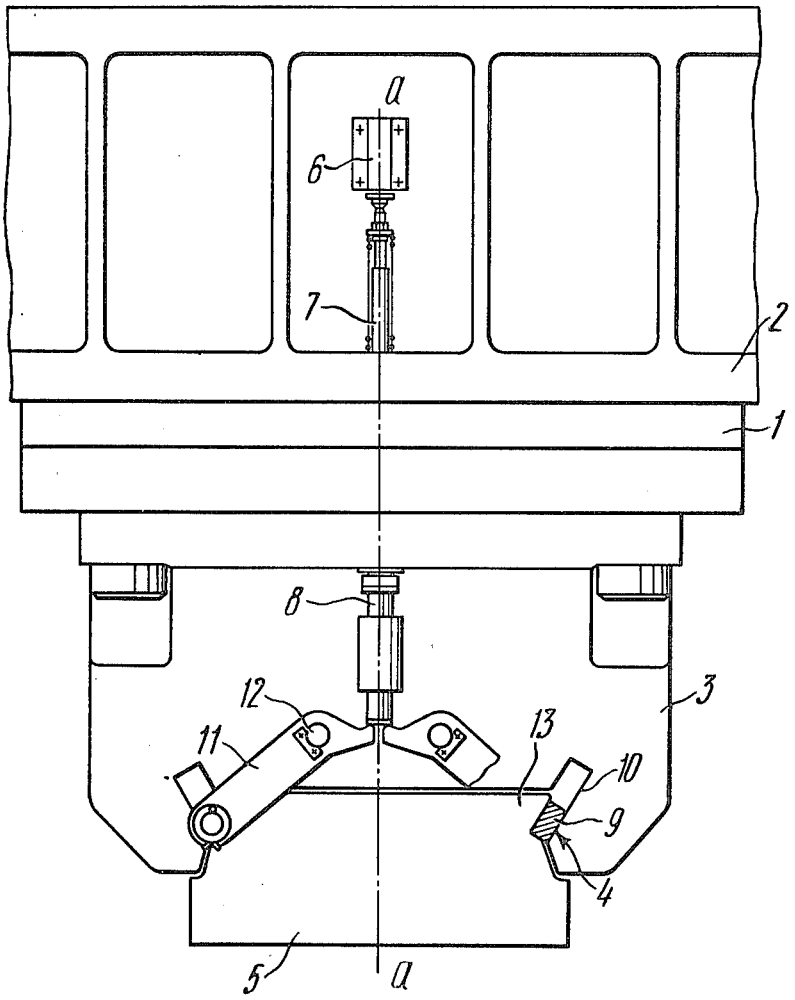
FIG. 1 is a general front view of the device for mounting a tool in accordance with the invention.
Figure 2:
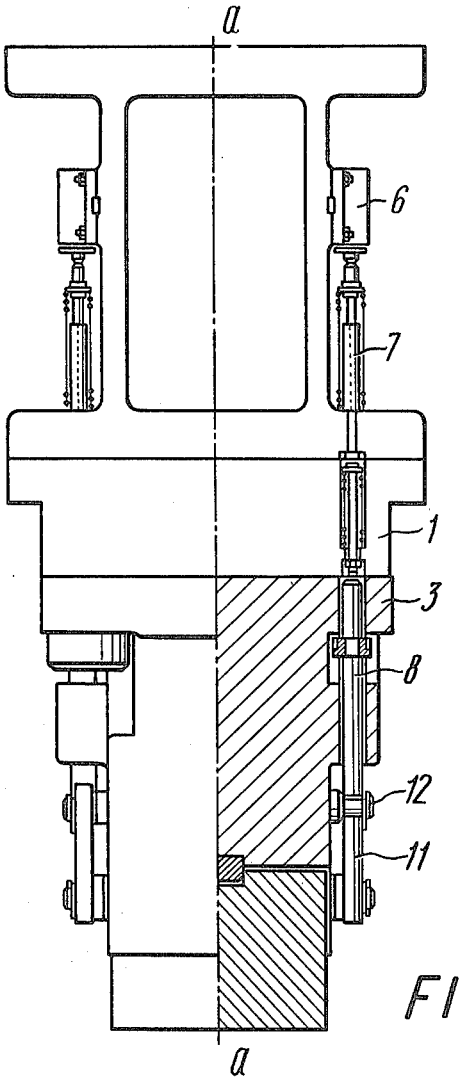
FIG. 2 is a partly sectional side elevation of the device shown in FIG. 1.

Referring now to the drawings, the herein disclosed device includes an adaptor plate 1 (FIG. 1) rigidly coupled to the movable crossbeam 2 of a press, and a tool holder 3 coupled to the plate 1. This tool holder 3 has arranged thereon, to both sides of the axis "a—a" of symmetry thereof, grippers 4 adapted to grip and hold a tool 5, e.g. a hammer. The grippers 4 are mounted for relative timed motion toward and away from the tool 5 under the action of power cylinders 6 mounted in the movable cross beam 2. The projectable piston rods 7 (FIG. 2) of the cylinders 6 are operatively connected with the grippers 4 through actuators 8. In one embodiment of the invention the grippers (4) include blocks 9 (FIG. 3) received in grooves 10 provided in the tool holder 3. The blocks 9 are operatively connected with the actuators 8 with aid of bell cranks 11 pivotable about pintles 12. The blocks 9 have bevels complementary to bevels provided on the tail part 13 of the tool 5, as it can be seen in FIG. 3.

Figure 4:
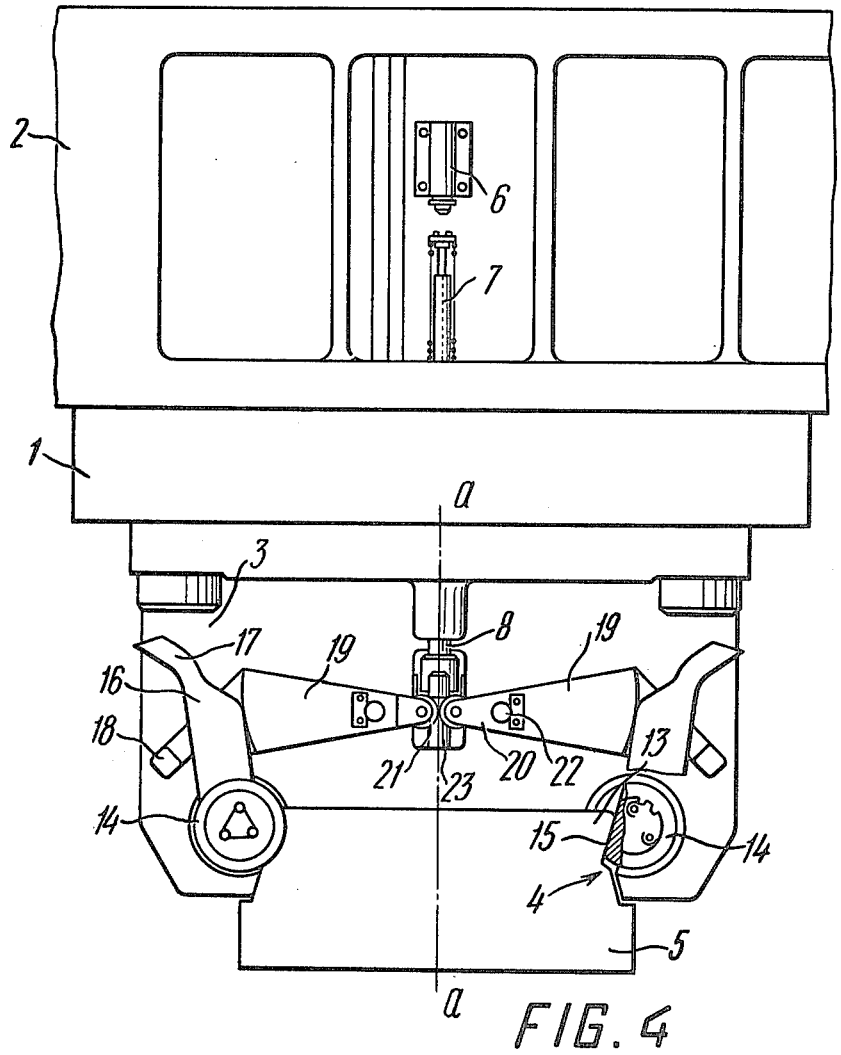
FIG. 4 illustrates another embodiment of the tool grippers.

In another embodiment of the invention each gripper 4 includes a roller 14 (FIG. 4) the external surface of which has made therein an axially extending flat 15 complementary to the bevels provided on the tail part 13 of the tool 5. The end faces of the roller 14 support thereon arms 16 having free ends in the form of contoured lugs 17 adapted to interact with the arms 18 of bell cranks 19. The other arms 20 of the bell cranks 19 have mounted thereon cams 21 adapted to cooperate with the rods 7 of the respective fluid power cylinders 6. The bell cranks 19 are mounted for pivoting about pintles 22. Retaining members 23 are mounted on the actuators 8 to prevent breakage of the bell cranks 19.

The herein disclosed device, e.g. with the grippers of the second embodiment, operates as follows.

When a tool 5 (e.g. a drop hammer) is to be either mounted or removed, the movable crossbeam 2 of the press is driven into its bottommost position whereat the tool or die 5 secured in the tool holder 3 engages the bottom part of the tool or die set mounted on the movable table (not shown) of the press.

With the working fluid under pressure supplied to the power cylinders 6, their rods 7 are projected and act upon the cams 21 of the bell cranks 19, through the actuators 8, whereby the bell cranks 19 are pivoted about their respective pintles 22, the arms 18 of the bell cranks 19 engaging the respective contoured lugs 17 of the arms 16 and thus rotating the rollers 14 into a position of releasing the tool 5, for tool replacement.

With the bell cranks 19 rotated, the spacing of the cams 21 increases, and the retaining members 23 freely lower between the cams 21, unwedging the bell cranks 19. In this position any rotation of the rollers 14 is prevented, which precludes an eventual breakdown, e.g. in case of absence of the working fluid under pressure in the cylinders 6, and the crossbeam 2 lowering upon the tool 5.

When the tool holder 3 lowers upon the tool 5, the rods 7 abut against the top face of the tool 5 through the actuators 8.

Now, with the pressure of the working fluid in the power cylinders 6 relieved, the bell cranks 19 to rotate by gravity to lower their longer arms, and act upon the contoured lugs 17 of the arms 16, whereby the rollers 14 are rotated. With the rollers 14 thus rotated, their flats are forced against the bevels of the tail part 13 of the tool 5, the bell cranks 19 wedging between the arms 16. In this position the abutment face of the tool 5 is firmly urged against the tool holder 3, and the press is prepared for operation.

To remove the tool 5 (with the crossbeam 2 lowered), the working fluid under pressure is supplied into the cylinders 6, whereby the bell cranks 19 are rotated and rotate the rollers 14, through the action of the arms 16. The crossbeam 2 is then raised, while the tool 5 remains on the lower part of the tool or die set, whereafter it is removed from the working zone of the press either by the corresponding stroke of the work table of the press, or else by the action of a device for transverse displacement of the tool. A new tool or die set is then positioned into the working zone, and the above cycle is repeated.

Figure 3:
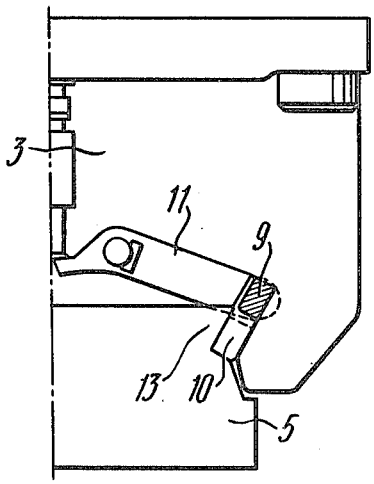
FIG. 3 illustrates one embodiment of tool grippers.

With the grippers of the first-described embodiment, the tool-mounting cycle is, as follows (FIG. 3).

With the working fluid under pressure supplied into the cylinders 6, their rods 7 act through the actuators 8 upon the arms of the bell cranks 11, whereby the latter are rotated about their pintles 12, driving the blocks 9 into a position whereat the tool 5 is released to be replaced.

With the pressure of the working fluid in the cylinders 6 relieved, the bell cranks 11 are rotated by gravity, whereby the blocks 9 are moved along the respective grooves 10 so that their bevels are forced against the corresponding bevels on the tail part 13 of the tool 5. In this position the abutment face of the tool 5 is firmly urged against the tool holder 3, and the press is prepared for operation.

To remove the tool 5 (with the crossbeam 2 lowered), the working fluid under pressure is supplied into the power cylinders 6, whereby the bell cranks are rotated to move the blocks 9 correspondingly. Then the crossbeam 2 is lifted, while the tool 5 remains on the bottom part of the tool or die set, whereafter it can be removed either by a corresponding stroke of the work table, or else by the action of a device for transverse displacement of the tool. Now a new tool or die set can be positioned into the working zone.

I claim:

1. A device for mounting a tool on the movable crossbeam of a press, comprising: a tool holder having an axis of symmetry and being fastened on the crossbeam of the press; tool grippers arranged to both sides of said axis of symmetry, mounted for relative motion toward and away from the tool; power cylinders mounted on said crossbeam and having rods and being adapted to effect said relative motion of said grippers, wherein each said gripper includes a block accommodated in a groove provided in said tool holder, a face of each block carrying thereon a bell crank of which a free arm is adapted to cooperate with the respective rod of said power cylinders, whereby the tool can be fastened on the crossbeam of the press.

2. A device for mounting a tool on the movable crossbeam of a press, comprising: a tool holder having an axis of symmetry and being fastened on the crossbeam of the press; tool grippers arranged to both sides of said axis of symmetry, mounted for relative motion toward and away from the tool; power cylinders having rods adapted to effect said relative motion of said grippers, wherein each one of said grippers includes a roller having an axially extending flat made in the external surface thereof, the end faces of each roller carrying arms of which the free ends are adapted to be engaged by the first arms of bell cranks of which the other arms carry cams adapted to cooperate with the rods of said power cylinders, whereby the tool can be fastened on the crossbeam of the press.

* * * * *